US009434593B2

(12) United States Patent
Krulitsch

(10) Patent No.: US 9,434,593 B2
(45) Date of Patent: Sep. 6, 2016

(54) FILLING ELEMENT

(71) Applicant: KHS GmbH, Dortmund (DE)

(72) Inventor: Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 97 days.

(21) Appl. No.: 14/399,609

(22) PCT Filed: Apr. 6, 2013

(86) PCT No.: PCT/EP2013/001036

§ 371 (c)(1),
(2) Date: Nov. 7, 2014

(87) PCT Pub. No.: WO2013/167223

PCT Pub. Date: Nov. 14, 2013

(65) Prior Publication Data

US 2015/0114518 A1 Apr. 30, 2015

(30) Foreign Application Priority Data

May 10, 2012 (DE) ..... 10 2012 009 207

(51) Int. Cl.
*B67C 3/26* (2006.01)
*B67C 3/28* (2006.01)
*B67C 3/22* (2006.01)

(52) U.S. Cl.
CPC ..... *B67C 3/26* (2013.01); *B67C 3/225* (2013.01); *B67C 3/28* (2013.01); *B67C 3/281* (2013.01); *B67C 3/282* (2013.01); *B67C 3/286* (2013.01)

(58) Field of Classification Search
CPC ..... B67C 3/28; B67C 3/281; B67C 3/286
USPC ..... 141/258, 264, 266, 296; 222/505, 509
See application file for complete search history.

(56) References Cited

U.S. PATENT DOCUMENTS 3,799,219 A * 3/1974 Uth ..... B67C 3/12 137/386
4,582,102 A * 4/1986 Risser ..... B67C 3/202 141/144
5,097,993 A * 3/1992 Davis ..... B67C 3/26 222/485
5,228,604 A * 7/1993 Zanini ..... B67C 3/281 222/504
5,273,082 A * 12/1993 Paasche ..... B67C 3/10 141/147
5,413,153 A * 5/1995 Zwilling ..... B65B 39/004 141/302
5,862,996 A * 1/1999 Crichton ..... B67C 3/281 141/264
6,817,386 B2 * 11/2004 Tsukano ..... B67C 3/281 141/146

FOREIGN PATENT DOCUMENTS

DE 16 32 004 11/1969
DE 26 23 039 12/1977
DE 2 04 902 12/1983

(Continued)

*Primary Examiner* — Timothy L Maust
(74) *Attorney, Agent, or Firm* — Occhiuti & Rohlicek LLP

(57) ABSTRACT

A filling element includes a housing, a channel formed in the housing's interior and having a dispensing opening to introduce content into a package, a valve having a valve body that moves along an axis to open and close the valve, an actuator to move the valve body, an axial-sliding guide, and a rod-like guide element that at least partly forms the sliding guide. The axial-sliding guide guides a guided structure on or inside the guide element, and is disposed solely outside the liquid channel. The axial-sliding guide is formed at least in part by the rod-like guide element. The guided structure is either the valve body, a valve tappet, or a combination thereof.

15 Claims, 3 Drawing Sheets

(56) References Cited

FOREIGN PATENT DOCUMENTS

| | | |
|---|---|---|
| DE | 196 40 673 | 4/1997 |
| DE | 20 2005 014 423 | 2/2006 |
| DE | 10 2010 005 033 | 7/2011 |
| EP | 0 111 629 | 6/1984 |
| EP | 0 615 948 | 9/1994 |
| EP | 1 323 667 | 7/2003 |
| EP | 1 411 023 | 4/2004 |
| WO | WO 98/30490 | 7/1998 |

* cited by examiner

FILLING ELEMENT

RELATED APPLICATIONS

This application is the national stage entry under 35 USC 371 of PCT application PCT/EP2013/001036, filed on Apr. 6, 2013, which claims the benefit of the May 10,2012 priority date of German application DE 10 2012 009 207.5, the contents of both of which are herein incorporated by reference.

FIELD OF DISCLOSURE

The invention relates to filling machines, and in particular, to a filling element.

BACKGROUND

Filling elements for use in filling systems or filling machines for filling packages, particularly bottles or similar containers, are known. These known filling elements fill bottles with liquid contents that contain solid particles. These solid particles typically include fruit fibers or fruit pieces.

In order for the valve body to correctly open the liquid valve, to close it again, and to do so in a way that is gentle on the materials, it is necessary for the stroke movement of the valve body to take place with a certain degree of precision. A known way to achieve this is to mount a valve tappet at two or more bearing positions that are offset axially from one another in such a way as to be axially displaceable in sliding guides. The sliding guides must be at a sufficient distance from one another to reliably prevent any operational faults. Such faults might otherwise occur as a result of, for example, tipping or tilting the valve tappet.

In known filling elements, the valve tappets are quite long. This results in greater axial dimensions for the filling element, The axial dimensions result both from having the bearing positions of the valve tappet be located outside of the product-carrying regions of the filling element, and from requiring the bearing positions to be at a sufficient distance from one another.

Also known are filling elements in which at least one of the sliding guides of the valve tappet is located within the product-carrying regions, i.e. within the liquid channel of the filling element. One disadvantage of this configuration is that solid constituents contained within the contents, for example fruit pieces, can be caught on this sliding guide and/or at narrowed regions caused by the sliding guide. This means that the filling element can become clogged. A clogged a filling element is difficult and time-consuming to clean, particularly at those regions or liquid paths that are narrowed by the guide.

SUMMARY

An object of the invention is to provide a filling element of reduced size that nevertheless reliably avoids the above-mentioned disadvantages and enables an optimal guiding of the valve body and/or valve tappet.

An apparatus according to the invention renders external bearing points superfluous. As a result, the design eliminates the need for bearing points outside of the housing interior, in which the liquid channel is also formed, without any guides being required in product-carrying regions of the filling element. The filling element according to the invention is particularly suitable for products or contents that contain solid constituents.

Further advantages of the invention include a more precise bearing and guidance of the valve body, particularly in the vicinity of the valve seat, while avoiding bearing points inside the liquid channel, and while also having a short or reduced axial extent.

In the context of the invention, the expression "substantially" or "approximately" mean deviations of ±10%, preferably ±5%, from the exact value in each case and/or deviations in the form of changes that do not affect the function.

In one aspect, the invention features an apparatus for filling a package with liquid content. The apparatus includes a filling element that has a filling-element housing, a liquid channel, a dispensing opening, a valve having a valve body, an actuator, an axial-sliding guide, and a rod-like guide element. The filling-element housing defines a filling-element-housing interior in which the liquid channel, which at least in part forms a dispensing opening that is disposed to introduce liquid content into the package, is formed. The actuator moves the valve body along an axis in an opening and closing stroke. This movement opens and closes the valve. The axial-sliding guide, which is configured to guide a guided structure, is disposed solely outside the liquid channel and is formed at least in part by the rod-like guide element, which extends along the axis. The guided structure is guided axially on or inside the rod-like guide element. The axis is either a stroke axis or a filling element axis. The guided structure is either the valve body, a valve tappet, or a combination of the valve body and the valve tappet.

In some embodiments, the rod-like guide element includes an end that is remote from the dispensing opening and that holds the rod-like guide element on the filling-element housing.

In other embodiments, the guided structure is guided on or in the rod-like guide element along an axial length that is at least twice as long as the opening and closing stroke. Among these are embodiments in which the guided structure is guided on or in the rod-like guide element along an axial length that is at least three times as long as the opening and closing stroke.

In yet other embodiments, the guided structure includes the combination of the valve body and the valve tappet. Among these embodiments are those in which the guided structure is hollow along a partial length thereof. Also among them are those embodiments in which the guided structure includes a bore extending along a partial length thereof. In either case, the guided structure is axially displaceable on the rod-like guide element.

In other embodiments, the valve body is hollow along a partial length thereof, and the valve body is axially guided on the rod-like guide element through the hollow partial length.

In yet other embodiments, the valve body includes a bore extending therethrough, and the valve body is axially guided on the rod-like guide element through the bore. In some of these additional embodiments, the bore has a closed end.

Also included among the embodiments are those in which the guided structure includes the valve tappet. In these embodiments, the rod-like guide element is a tubular rod-like guide element, and the valve tappet is axially guided in the tubular rod-like guide element. The guide element has an end that protrudes from the rod-like guide element and that is remote from the actuator. In these embodiments, the rod-like guide element is connected to the valve body by this end.

In other embodiments, the axial-sliding guide includes a sliding bearing provided on the rod-like guide element, the valve body, or the valve tappet.

Also included are embodiments that have a seal that separates the axial-sliding guide and the liquid channel.

Additional embodiments have a valve seat. In these embodiments, the valve body has a region that cooperates with the valve seat. At or in a vicinity of this region, the valve body is guided on the rod-like guide element. When the liquid valve is closed, a distance between the valve seat and the guide is less than three times as long as the opening and closing stroke.

In some embodiments, the rod-like guide element includes a guide rod.

In other embodiments, the axial-sliding guide extends at least partially into the filling-element-housing interior.

Further developments, advantages and possible uses of the invention will become apparent from the following description of examples of embodiments and from the figures. All the features described and/or shown in the figures, per se or in any combination, form in principle the subject matter of the invention, regardless of the way in which they are combined or refer back to one another in the claims. The content of the claims also forms part of the description.

BRIEF DESCRIPTION OF THE FIGURES

The invention will be explained in more detail below with reference to FIGS. 1-3, which each show simplified schematic sectional view of different embodiments of filling elements.

DETAILED DESCRIPTION

Figure 1:
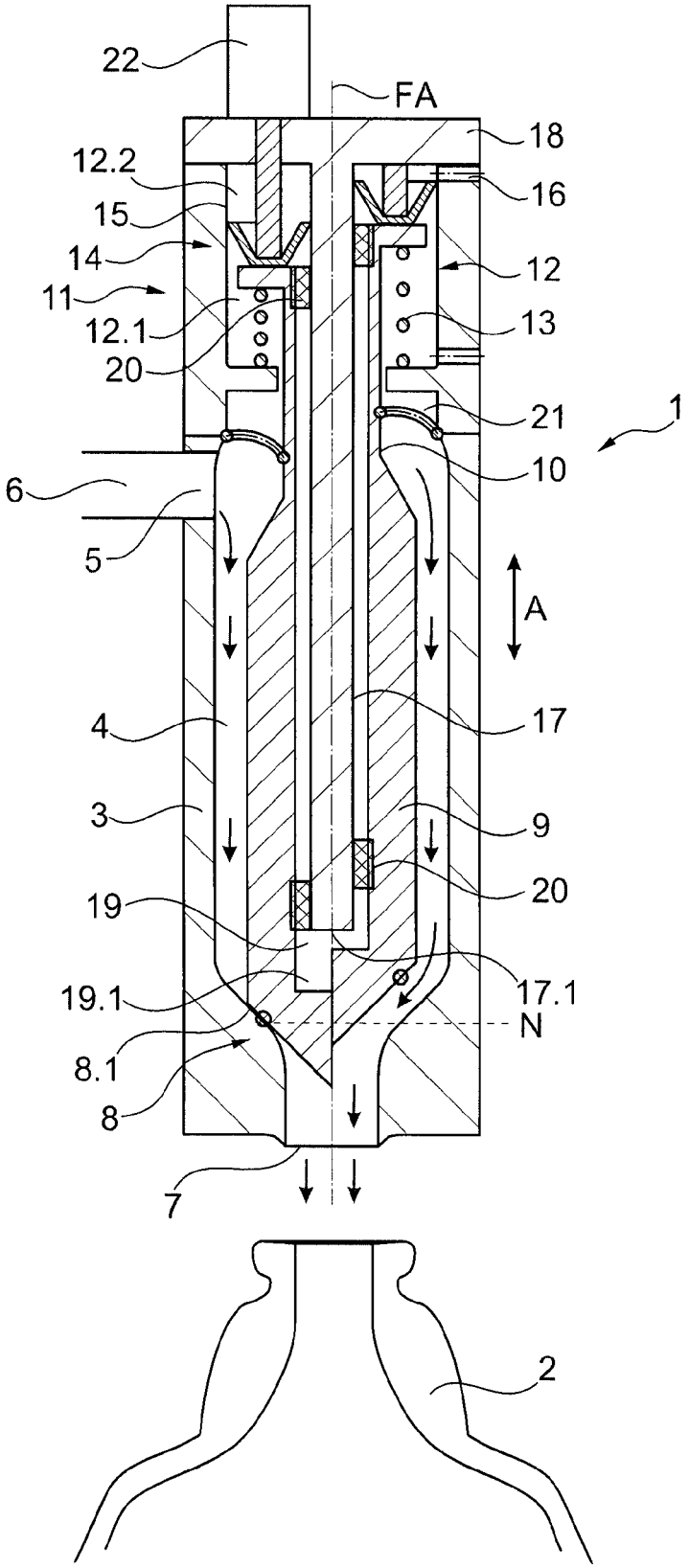

FIG. 1 shows a filling element 1 of a filling system or filling machine for filling containers 2, for example in the form of bottles, with liquid contents. The filling element 1 is part of a filling machine (not shown in detail). In one embodiment, the filling machine is a rotary filling machine that has identical filling elements disposed along a periphery of a rotating transport element. A typical rotating transport element is a rotor that rotates about a vertical machine axis.

The filling element 1 comprises a housing 3 having an interior through which is formed a liquid channel 4 for passage of the contents. Via a connection 5 at its upper region, the liquid channel 4 connects to a product line 6 that connects to a contents tank (not shown) of the filling machine and that supplies the liquid contents. On the underside of the housing 3, the liquid channel 4 forms a dispensing opening 7 via which the liquid contents flow towards a container 2 during the filling process.

Provided within the liquid channel 4, between the connection 5 and the dispensing opening 7, is a liquid valve 8 with a valve body 9 that is moved by a predefined stroke A along a filling element axis FA. As the valve body 9 moves up and down along the stroke A, it opens and closes the liquid valve 8. When the liquid valve 8 is closed, the valve body 9 bears against a valve seat 8.1 formed on the inner face of the liquid channel 4.

The liquid valve 8 is radially symmetric about the filling element axis FA. Thus, to save space, FIG. 1 shows the valve in both its open position and its closed position.

In particular, on the left-hand side of FIG. 1, to the left of the filling element axis FA, the liquid valve 8 is shown in its closed state. The valve 8 is shown in its open state on the right-hand side of the figure, to the right of the filling element axis FA.

The valve body 9 is formed on a valve tappet 10 that, together with the valve body 9 forms a valve body/valve tappet unit 9/10. An actuating device 11 acts upon the valve body/valve tappet unit 9/10 to cause the axial movement of the valve body 9 along a stroke A.

The actuating device 11, which is accommodated in a separate chamber 12 of the housing 3 or of the housing interior, comprises a spring 13 that biases the valve body 9 into the open state. This spring 13 is accommodated in a first sub-volume 12.1 of the chamber 12. The actuating device 11 also includes a pneumatically operated piston/cylinder arrangement 14 by which the valve body 9 is moved against the force exerted by the spring 13 and into its closed state.

In the illustrated embodiment, the piston/cylinder arrangement 14 is formed using an upper end of the valve tappet 10 in FIG. 1 and using a piston seal 15. The resulting piston is arranged in an axially displaceable manner in a second sub-volume 12.2 of the chamber 12, which serves as a cylinder chamber. The second sub-volume 12.2 can be acted upon by the pneumatic pressure medium via a connection 16. A membrane seal 21 seals off the liquid channel 4 from the chamber 12.

A special feature of the filling element 1 lies in the fact that the valve body/valve tappet unit 9/10 formed by the valve body 9 and the valve tappet 10 is guided internally, namely along by far most of its axial length, on a guide rod 17 that is arranged to be coaxial with the filling element axis FA and that, during the opening and closing of the liquid valve 8, is not moved with the valve body 9 and the valve tappet. Instead, as shown in FIG. 1, the guide rod 17 is held at its upper end against a cover 18 that seals the chamber 12.

The guide rod 17 is accommodated within an opening or bore 19 that is coaxial with the filling element axis FA in the valve body 9 and in the valve tappet 10 or in the valve body/valve tappet unit 9/10. The opening or bore is closed at a lower end 19.1 of the valve body 9 adjacent to the dispensing opening 7 and is open at an upper end of the valve tappet 10 remote from the dispensing opening 7.

In the illustrated embodiment, the bore 19 extends over almost the entire length of the valve body/tappet arrangement 9/10 so that, when the liquid valve 8 is closed, the closed end 19.1 of the bore 19 is located approximately at the level N of the valve seat 8.1. The guide rod 17 preferably extends over almost the entire length of the bore 19 so that, when the liquid valve 8 is closed, the axial distance between the lower end 17.1 of the guide rod 17 and the closed end 19.1 of the bore 19 is only somewhat greater than the maximum stroke A of the valve body 9 when opening and closing the liquid valve.

Two sliding bearings 20 on the inner face of the bore 19 cooperate with the guide rod 17. An upper one of the sliding bearings 20 is located at the upper, open end of the bore 19. A lower one of the sliding bearings 20 is provided such that, when the liquid valve 8 is closed, it is located at the lower end 17.1 of the guide rod, namely at only a slight axial distance above the level N of the valve seat 8.1. In the illustrated embodiment this slight axial distance corresponds at most to 2.5 times the length of the stroke A.

As a result of the described design, a sliding guidance of the valve body/valve tappet unit 9/10 along a large axial length, namely the distance between the two sliding bearings 20, is achieved with reduced dimensions of the filling element 1 in the direction of the filling element axis FA. Also as a result of the described design, a precise sliding guidance of the valve body/valve tappet unit 9/10 is achieved in the direct vicinity of that region of the valve body 9 that cooperates with the valve seat 8.1 without any elements of the sliding guide being located in a product-carrying or content-carrying region of the filling element 1, even though the guide rod 17 extends within that part of the housing interior that also forms the liquid channel 4.

In order to limit the opening stroke of the valve body/valve tappet arrangement a stroke limiter 22 is provided in the cylinder chamber, namely the second sub-volume 12.2, of the piston/cylinder arrangement 14. The stroke limiter 22 is designed, for example, as a stroke limiter with a damping function, e.g. as a pneumatic stroke-limiter.

Figure 2:
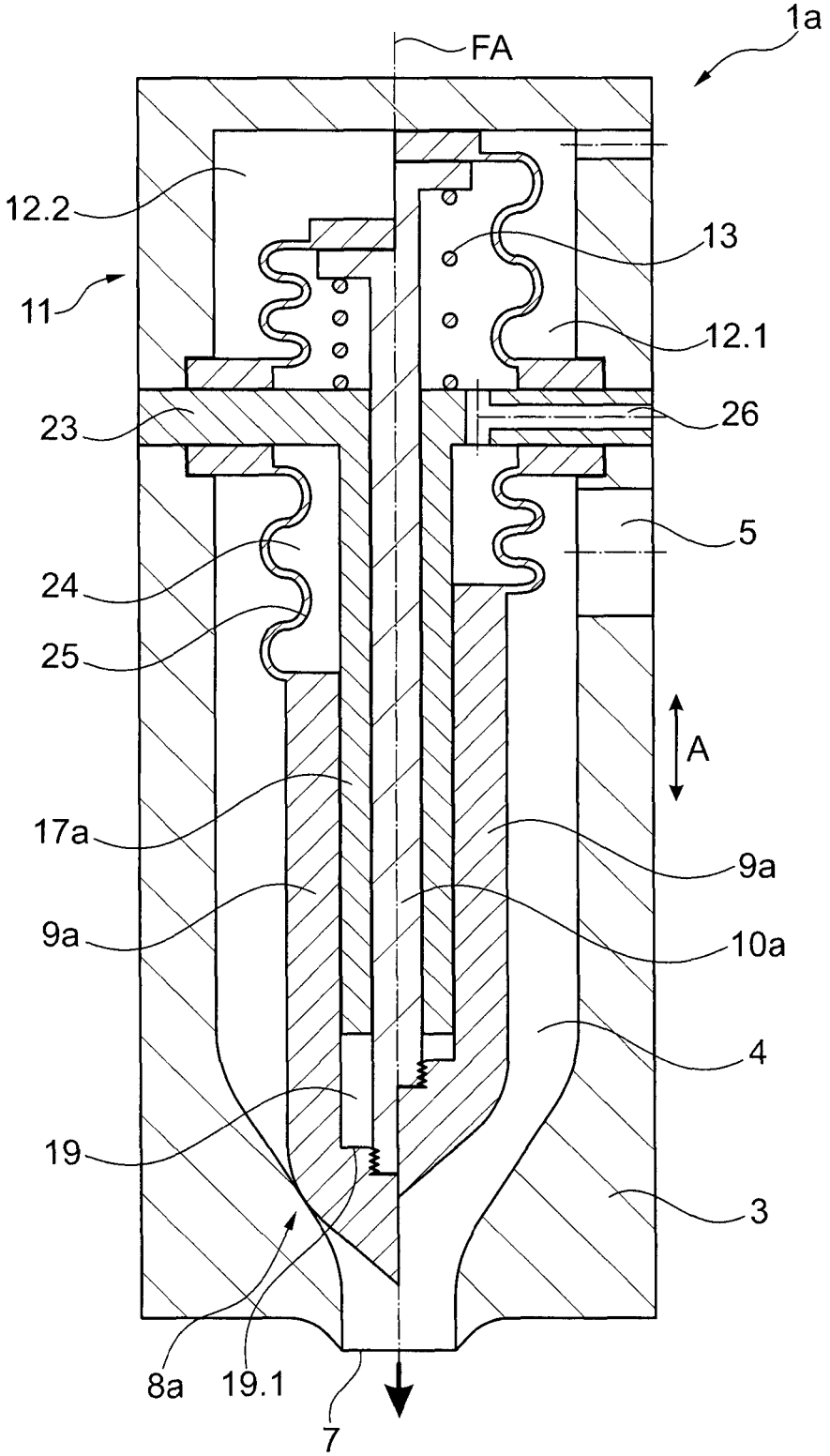

FIG. 2 shows a second embodiment of a filling element la that differs from the first embodiment of the filling element 1 primarily because a valve body 9*a* that forms the liquid valve 8*a* and the valve tappet 10*a* that connects the valve body 9*a* to the actuating device 11 are each guided separately on or in a guide rod 17*a*, which is designed as a hollow tube. The valve body 9*a* is once again provided with the bore 19 into which the guide rod 17*a* extends. The bore 19 is open at the upper end of the valve body 9*a* remote from the dispensing opening 7 and is closed at the lower end 19.1 of the valve body adjacent to the dispensing opening 7.

Further embodiments include measures for avoiding an undesired rotation of the valve body 9*a* about the filling element axis FA. Examples of such measures include having a guide rod 17*a* that has, on its outer face, a non-circular cross-section. Other examples include having a guide rod 17*a* that includes a strip-like protrusion that extends in the direction of the filling element axis FA and that engages a groove 19.2 on the inner face of the bore 19.

In all the embodiments, the valve tappet 10*a*, which is coaxial with the filling element axis FA, is guided in the bore or opening of the guide rod 17*a*. The bore or opening is open at both ends, and is connected by its lower end, which protrudes from the guide rod 17*a*, to the valve body 9*a* in the region of the lower end 19.1 of the bore 19. The guide rod 17*a* is held, by its upper end, on an intermediate wall 23 of the housing.

The filling element 1*a* otherwise corresponds to the filling element 1, so that the same references as in FIG. 1 are used in FIG. 2 for those elements that correspond, at least in terms of their function, to the elements of the filling element 1. In order to separate the liquid channel 4 from the region or third sub-volume 24 of the interior of the housing 3 at which the guide rod 17*a* is exposed, and in order to avoid any penetration of contents into the gap between the valve body 9*a* and the guide rod 17*a*, a membrane seal 25 is provided between the upper end of the valve body and the housing's intermediate wall 23 and extends once again within the part of the housing interior that also forms the liquid channel 4, but without the guide rod 17*a* being located in product-carrying or content-carrying regions of the filling element 1*a*.

A channel 26 is connected to the third sub-volume 24 and also to the first sub-volume 12.1. Leakage monitoring of the filling element 1*a* is possible via the channel 26.

Figure 3:
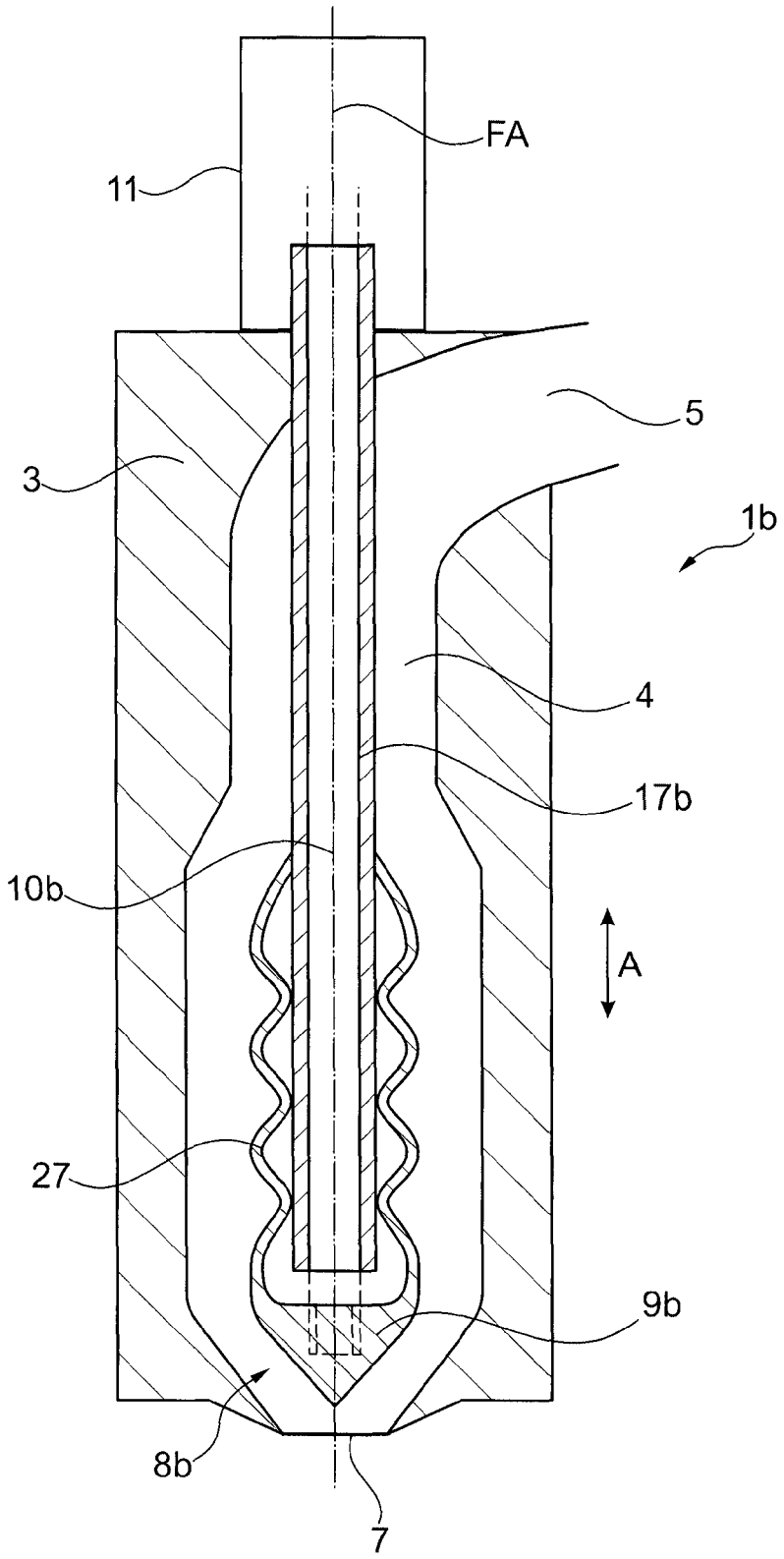

FIG. 3 shows a third embodiment of a filling element 1*b* comprising a guide rod 17*b* that is designed as a hollow tube and that is held at its upper end, remote from the dispensing opening 7, in the housing 3 of the filling element 1*b* and that once again extends within the part of the housing interior that also forms the liquid channel 4. The valve tappet 10*b*, which cooperates with the actuating device 11, is guided along a considerable axial length in the guide rod 17*b*, which is arranged coaxial with the filling element axis FA. The valve body 9*b* of the liquid valve 8*b* is provided on the valve tappet 10*b* at the lower end protruding from the guide rod 17*b*. In order to avoid any penetration of contents into the guide between the valve tappet 10*b* and the guide rod 17*b*, a seal 27 is provided to connect the valve body 9*b* to the outer face of the guide rod 17*b*. In the illustrated embodiment, the seal 27 is designed as a concertina.

An advantage of the second and third embodiments of the filling element 1*a*, 1*b* is that the valve body 9*a*, 9*b* is guided on the guide rod 17*a*, 17*b* along a considerable axial length, including in the direct vicinity of that region that cooperates with the valve seat. Another advantage is that, in order to reduce the size of the filling element 1*a*, 1*b*, the guide rod 17*a* or 17*b* is accommodated in the housing interior of the filling element lb that also forms the liquid channel 4, namely with effective separation of the liquid channel 4 from the respective guide.

The invention has been described above on the basis of examples of embodiments. It will be understood that further changes and modifications are possible without thereby departing from the inventive concept on which the invention is based.

Having described the invention, and a preferred embodiment thereof, what is claimed as new, and secured by letters patent is:

1. An apparatus for filling a package with liquid content, said apparatus comprising a filling element, wherein said filling element comprises a filling-element housing, a liquid channel, a dispensing opening, a valve having a valve body, an actuator, an axial-sliding guide, and a rod-like guide element, wherein said filling-element housing defines a filling-element-housing interior, wherein said liquid channel is formed in said filling-element-housing interior, wherein said dispensing opening is formed at least in part by said liquid channel, wherein said dispensing opening is disposed to introduce said liquid content into said package, wherein said valve body is movable along an axis, wherein said actuator is configured to move said valve body along said axis in an opening and closing stroke, wherein movement of said valve body along said axis results in opening and closing said valve, wherein said axial-sliding guide is configured to guide a guided structure, wherein said axial-sliding guide is disposed solely outside said liquid channel, which is occupied by said liquid contents, wherein said axial-sliding guide is formed at least in part by said rod-like guide element, wherein said rod-like guide element extends along said axis, wherein said guided structure is guided axially on or inside said rod-like guide element, wherein said axis is selected from the group consisting of a stroke axis and a filling element axis, and wherein said guided structure is selected from the group consisting of said valve body, a valve tappet, and a combination of said valve body and said valve tappet.

2. The apparatus of claim 1, wherein said rod-like guide element comprises an end, wherein said end is remote from said dispensing opening, and wherein said rod-like guide element is held on said filling-element housing by said end.

3. The apparatus of claim 1, wherein said guided structure is guided on or in said rod-like guide element along an axial length that is at least twice as long as said opening and closing stroke.

4. The apparatus of claim 3, wherein said guided structure is guided on or in said rod-like guide element along an axial length that is at least three times as long as said opening and closing stroke.

5. The apparatus of claim 1, wherein said guided structure comprises said combination of said valve body and said valve tappet, wherein said guided structure is hollow along a partial length thereof, and wherein said guided structure is axially displaceable on said rod-like guide element.

6. The apparatus of claim 1, wherein said guided structure comprises said combination of said valve body and said valve tappet, wherein said guided structure comprises a bore extending along a partial length thereof, and wherein said guided structure is axially displaceable on said rod-like guide element.

7. The apparatus of claim 1, wherein said valve body is hollow along a partial length thereof, wherein said valve body is axially guided on said rod-like guide element through said hollow partial length.

8. The apparatus of claim 1, wherein said valve body comprises a bore extending therethrough, wherein said valve body is axially guided on said rod-like guide element through said bore.

9. The apparatus of claim 8, wherein said bore has a closed end.

10. The apparatus of claim 1, wherein said guided structure comprises said valve tappet, wherein said rod-like guide element is a tubular rod-like guide element, wherein said valve tappet is axially guided in said tubular rod-like guide element, wherein said rod-like guide element has an end, wherein said end protrudes from said rod-like guide element, wherein said end is remote from said actuator, and wherein said rod-like guide element is connected to said valve body by said end.

11. The apparatus of claim 1, wherein said axial-sliding guide comprises a sliding bearing provided on at least one of said rod-like guide element, said valve body, and said valve tappet.

12. The apparatus of claim 1, further comprising a seal, wherein said seal separates said axial-sliding guide and said liquid channel.

13. The apparatus of claim 1, further comprising a valve seat, wherein said valve body comprises a region that cooperates with said valve seat, wherein at or in a vicinity of said region, said valve body is guided on said rod-like guide element, wherein, when said liquid valve is closed, a distance between said valve seat and said guide is less than three times as long as said opening and closing stroke.

14. The apparatus of claim 1, wherein said rod-like guide element comprises a guide rod.

15. The apparatus of claim 1, wherein said axial-sliding guide extends at least partially into said filling-element-housing interior.

* * * * *